US005536179A

United States Patent [19]

Olsson et al.

[11] Patent Number: 5,536,179

[45] Date of Patent: Jul. 16, 1996

[54] ELECTRICAL CONNECTOR WITH GROUND BUS INSERT

[75] Inventors: Billy E. Olsson, New Cumberland; Iosif Korsunsky, Harrisburg, both of Pa.

[73] Assignee: The Whitaker Corporation, Wilmington, Del.

[21] Appl. No.: 279,728

[22] Filed: Jul. 25, 1994

[51] Int. Cl.[6] ..... H01R 4/66; H01R 9/09

[52] U.S. Cl. ..... 439/108

[58] Field of Search ..... 439/108, 98, 62, 439/604, 607, 65, 67

[56] References Cited

U.S. PATENT DOCUMENTS

| | | | |
|---|---|---|---|
| 4,094,564 | 6/1978 | Cacolici | 439/604 X |
| 4,615,578 | 10/1986 | Stadler et al. | 439/607 |
| 4,695,106 | 9/1987 | Feldman et al. | 439/108 X |
| 4,758,693 | 7/1988 | Hoffman | 200/11 R |
| 4,762,500 | 8/1988 | Dola et al. | 439/79 |
| 4,935,284 | 6/1990 | Puerner | 428/137 |
| 5,120,232 | 6/1992 | Korsunsky | 439/108 |
| 5,199,885 | 4/1993 | Korsunsky et al. | 439/79 |
| 5,376,009 | 12/1994 | Olsson et al. | 439/67 |
| 5,383,095 | 1/1995 | Korsunsky et al. | 439/65 |
| 5,411,404 | 5/1995 | Korsunsky et al. | 439/108 |
| 5,413,491 | 5/1995 | Noschese | 439/108 |

*Primary Examiner*—William Briggs
*Attorney, Agent, or Firm*—Anton P. Nass

[57] ABSTRACT

A miniature electrical connector (10) having two rows of closely spaced signal contacts (40) extending from a board-mounting face (30) to a mating face (32), and having extended height. An insert (100) is assembled within a large cavity (36) of the housing (20) to define inner walls of passageways of the housing containing the contacts (40). A planar metal member (102) of the insert can define a ground bus for preventing crosstalk between the two rows of contacts, or can facilitate assembly and retention of the insert in the housing, or both, providing very thin elongate inner walls for the contact passageways while simplifying molding of the housing.

17 Claims, 10 Drawing Sheets

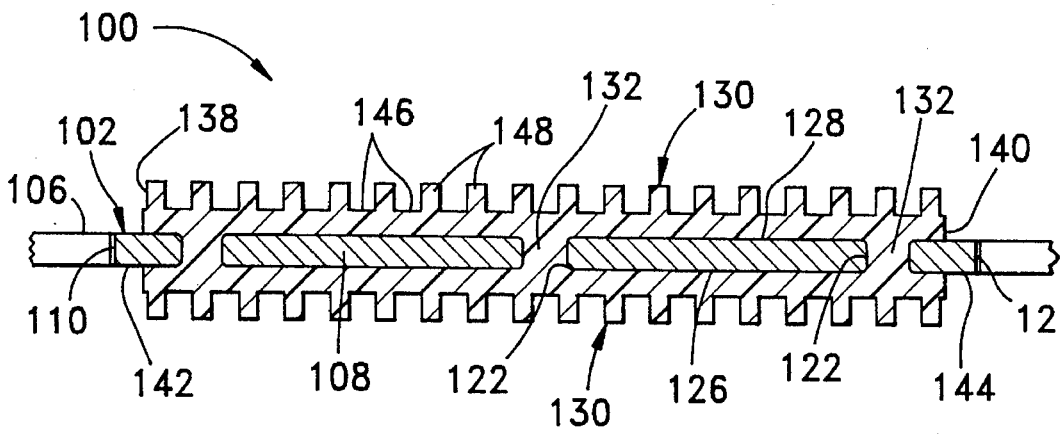
Fig. 6
Fig. 7
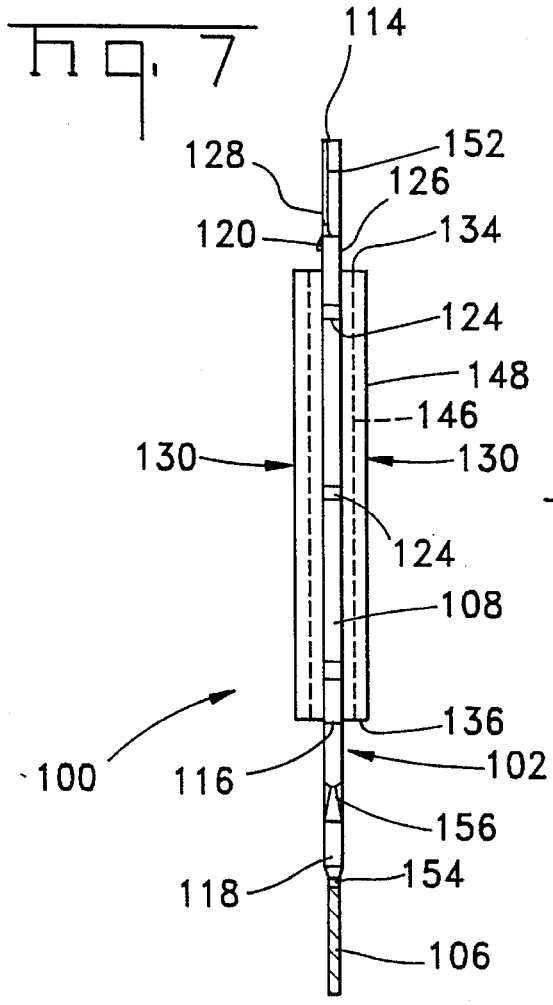
Fig. 4
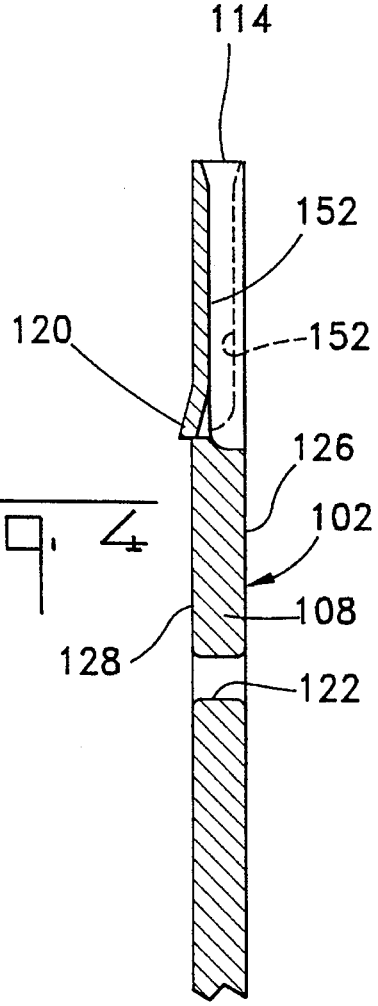

ELECTRICAL CONNECTOR WITH GROUND BUS INSERT

FIELD OF THE INVENTION

The present invention is directed to the field of electrical connectors and more particularly to miniature connectors having closely spaced contact members and also to connectors including a ground bus centered between rows of closely spaced signal contacts.

BACKGROUND OF THE INVENTION

An electrical connector assembly is known for interconnecting a mother board and daughter card, in which a plurality of signal contact members are arrayed closely spaced in two elongate rows disposed in respective passageways of a housing of dielectric material. The assembly includes a first connector mounted to the mother board along a surface thereof, and a second connector mounted to an edge of the daughter card and matable with the first connector. In each connector a ground bus member is disposed in a central slot between the rows of signal contacts and provides protection against crosstalk that otherwise would degrade the signals transmitted by the closely spaced signal contacts between the mother board and daughter card. In a larger version, the connectors can have a plurality of signal contact arrays along the length, each with a separate ground bus member therebetween. The ground bus members are generally planar metal members adapted to electrically engage each other in an interwoven fashion transversely along their lengths upon connector mating to provide a continuous ground plane through the mated connector assembly, thereby minimizing the width of the connector assembly.

Such matched impedance connectors are disclosed, for example, in U.S. Pat. No. 5,120,232 and are sold by AMP Incorporated under the MICTOR trademark, a mating plug and receptacle pair having Part Nos. 767003 and 767004; a similar connector assembly is disclosed in U.S. Pat. No. 5,199,885. In the first connector the signal terminals include first contact sections along the board-mounting face extending at right angles to free ends adapted to be surface mounted to conductive pads of the mother board, while the ground buses include post sections extending from the board-mounting face to be inserted into throughholes of the board and soldered to ground circuits thereof. The second contact sections are exposed along the connector mating face to become electrically connected to complementary second contact sections of corresponding signal contacts of the second connector. In the second connector, the first contact sections extend outwardly from the card-mounting face to be soldered to conductive pads of the daughter card, while post sections of the ground buses are inserted into the edge surface to become electrically engaged with ground circuits of the card at transverse through-holes spaced inwardly from the edge. In each connector the second contact sections comprise tines of unequal length extending from a body section and defining pairs of cantilever beam spring arms disposed transversely of the contact rows, with edges thereof being bearing surfaces matable with corresponding portions of the associated second contact sections of the other connector providing redundant electrical engagement for signal transmission of assured integrity. In both connectors the signal contacts are retained in the plastic housings by an interference fit in precisely molded passageways, enhanced by low height protuberances of the contact body sections.

In the MICTOR product, the signal contacts are spaced apart a distance of 0.025 inches. The body sections of the signal contacts are essentially planar, formed from sheet metal, and the housing walls between the contacts are only about 0.011 inches thick and must retain the contacts firmly and precisely located, all with severely restrictive tolerances during manufacture. Each ground bus of a thickness of 0.018 inches, with each ground bus and corresponding housing slot therefor having a transverse length of 0.468 inches. To maintain the minimized overall dimensions of the connector, the walls between the innermost side walls of the signal contact passageways and the ground bus slot are only 0.014 inches thick. In the connector, the signal contacts and the ground buses are force fit into the passageways and slot respectively, thus stressing the thin walls.

It is desired to provide a connector having two rows of elongate contact members that has an insulative housing that is simple to mold precisely in an elongated design with closely spaced contact-receiving passageways having thin barrier walls therebetween for closely spaced contacts, for a precisely dimensioned connector that is economical to manufacture and simple to assemble.

It is desired to provide a connector having two rows of elongate signal contact members and a ground bus member therebetween all in an insulative housing of minimized dimensions in a manner reducing the stress on the thin walls while maintaining the precise positioning of the signal contacts and the ground bus in the housing.

It is further desired to provide such a connector with an increased height between the board-mounting face and the mating face, while maintaining the precision in the dimensions of the insulative material during molding.

Additionally, it is desired to provide such a miniature connector that extends for a substantial distance from a first circuit board to which it is mounted, such that together with a complementary mating connector mounted to a second circuit board parallel to the first circuit board, they interconnect a pair of circuit boards that must be spaced apart a substantial distance within an apparatus or a framework, in order for the spacing to provide a clearance for other electrical or electronic components mounted to one or both boards and that have substantial height, and also clearance to enable air flow for dissipation of heat from such components.

SUMMARY OF THE INVENTION

The present invention provides a miniature electrical connector having closely spaced signal contacts in a pair of rows and separated by thin barrier walls and able to have a deliberately substantial height, and enables precision molding and simplified assembly that minimizes the risk of damage to either the contacts or the thin walls within the housing.

In a particularly useful embodiment, the present invention provides a miniature electrical connector having closely spaced signal contacts in a pair of rows separated by one or more ground bus members therealong, occupying little real estate of a circuit board to which it is to be mounted. The otherwise miniature connector is shown to be able to have a deliberately substantial height for, together with a complementary connector, providing interconnections between a pair of parallel circuit boards needing to be spaced substantially apart and yet interconnected.

The housing is molded to provide an outermost signal contact passageway portion for the outer tine of the second contact section of each signal contact, and also the outer half of the innermost signal contact passageway portion for the inner tine of the second contact section, while defining a wide central slot. Each ground bus member includes a plate-like body section with the matable contact section along one longitudinal edge, an array of post sections extending from the opposed longitudinal edge, and barbs defined along both side edges. Insulative material is molded to both major side surfaces of the ground bus body section in a manner exposing the matable contact sections and post sections and also a limited amount of each side edge portion, all defining a ground bus insert.

The outwardly facing surfaces of the insulative material of the ground bus insert are molded to provide an array of precisely positioned and shaped grooves that will define the inner half of the innermost signal contact passageway portion for the inner tine of the second contact section, upon insertion of the ground bus insert into the wide central slot of the housing. Upon ground bus insertion, the exposed side edge portions are slid into grooves at opposed ends of the wide central slot, and upon full insertion the barbs of the side edges will bite into the groove bottoms to retain the ground bus insert into the housing.

It is an objective of the present invention to provide an electrical connector of the type having a ground bus plate centered between two rows of signal contacts, with a ground bus insert inclusive of insulative material integrally molded thereto thereby facilitating precision manufacturing of the housing of the connector especially to assure the necessary thickness of insulative material between the ground bus and the signal contacts.

It is another objective to provide assembly of such a connector in a manner assuring the integrity of thin walls of insulative material between the ground bus and the signal contacts.

It is yet another objective to provide such a connector having increased height while maintaining the precision of the passageways for the signal contacts and the ground bus, to be suitable for use in interconnecting parallel circuit boards mounted in an apparatus a substantial distance apart.

An embodiment of the present invention will now be described by way of example with reference to the accompanying drawings.

BRIEF DESCRIPTION OF THE DRAWINGS

FIGS. 2 and 3 are isometric and elevation views of a pair of ground bus members attached to a carrier strip respectively, after being stamped into a blank from a continuous strip of metal;

FIG. 4 is an enlarged partial cross-sectional view of one of the ground bus members of FIGS. 2 and 3 taken along lines 4—4 of FIGS. 3 at the matable contact section;

FIGS. 5 to 7 are isometric, cross-sectional and side views of the ground bus insert after dielectric material has been molded about the ground bus members of FIGS. 2 to 4, with FIG. 6 taken along lines 6—6 of FIG. 5;

DETAILED DESCRIPTION OF THE PREFERRED EMBODIMENT

Figure 1:
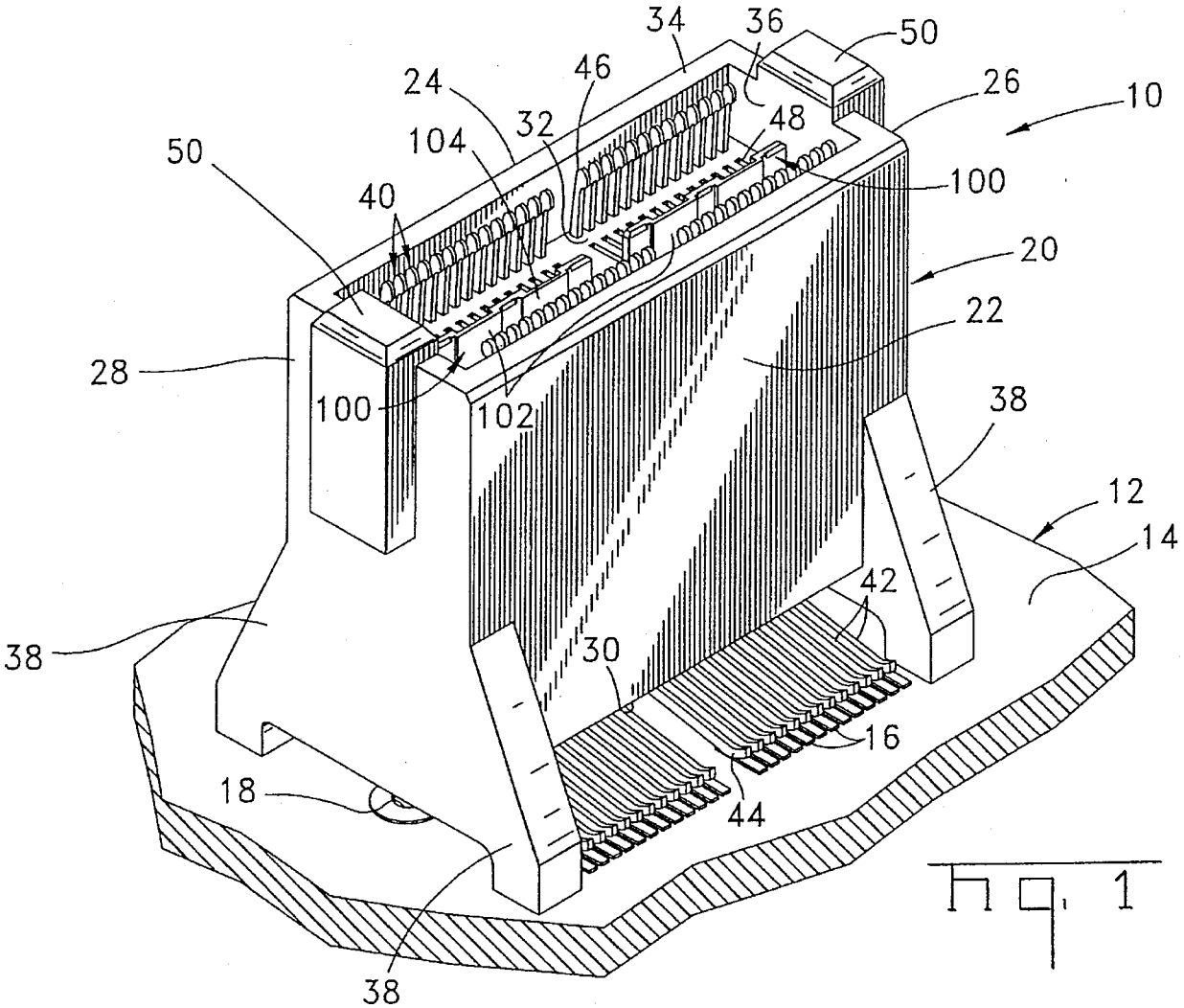
FIG. 1 is an isometrics view of the connector of the present invention, mounted a circuit board.
Figure 2:
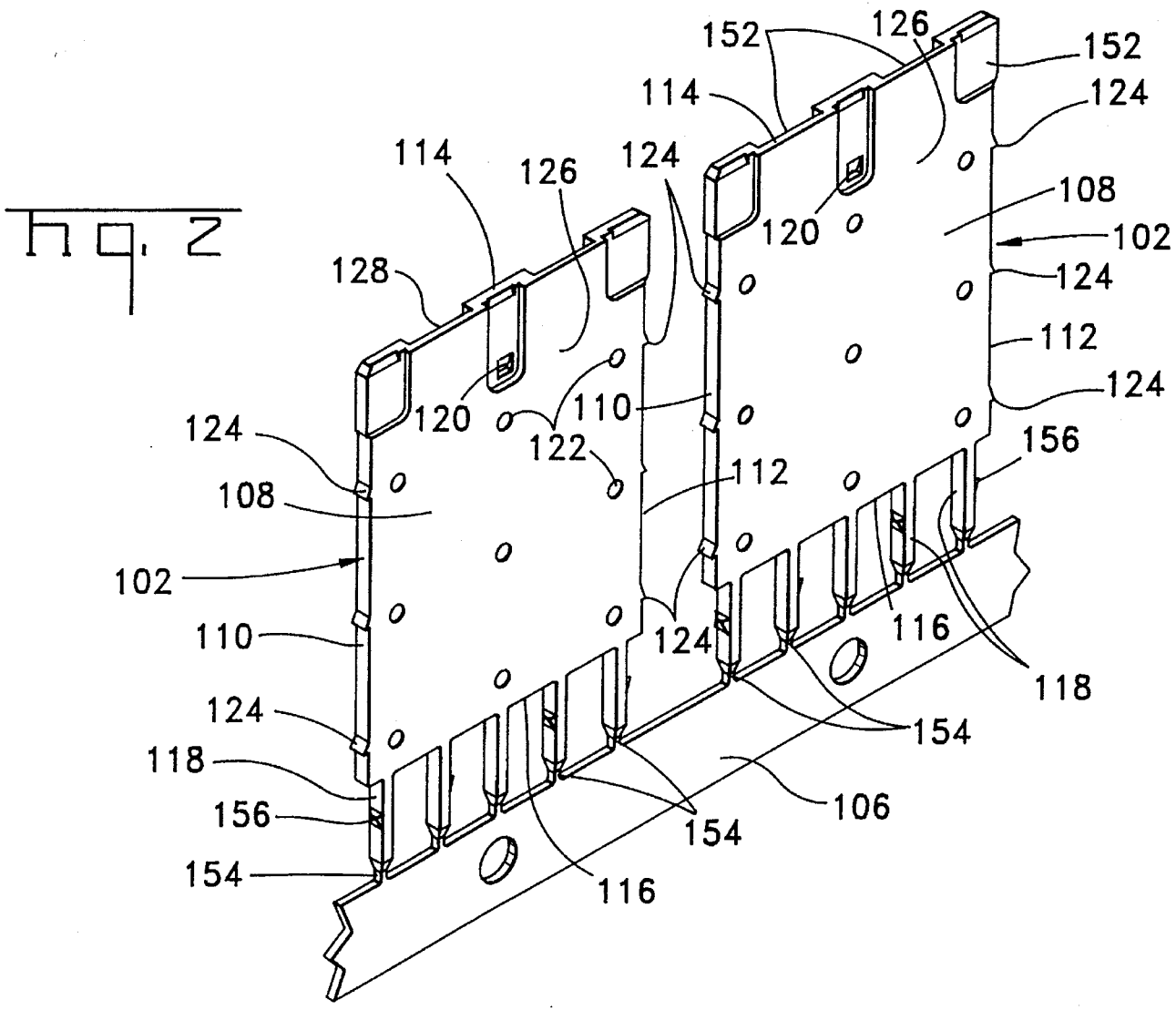

Electrical connector 10 includes a housing member 20 of dielectric material and having opposed side walls 22,24 and opposed end walls 26,28 extending from a board-mounting face 30 to a mating face 32 including a shroud 34 extending forwardly therefrom to define a large plug-receiving cavity 36. A pair of buttresses 38 at each end wall provide stabilized mounting of connector 10 to circuit board 12. A plurality of signal contacts 40 are disposed within housing member 20 and include first contact sections 42 extending from board-mounting face 30 and along major surface 14 of circuit board 12 to free ends 44, and are soldered to respective conductive pads 16 of circuit board 12 proximate free ends 44. Plating material is seen surrounding a plated through-hole 18 of circuit board 12 into which is inserted and soldered a post section a ground bus of the connector (see FIG. 10).

At mating face 32 within shroud 34, elongate outer tines 46 of second contact sections of signal contacts 40 are seen exposed in large cavity 36 along mating face 32 to become electrically engaged with corresponding shorter outer tines of the signal contacts of another connector (not shown) upon mating. Also seen are openings 48 associated with a shorter inner tine (FIG. 10) of each second contact section for receipt thereinto of an elongate inner tine portions of the corresponding signal contacts of the other connector for mating with the shorter inner tine of connector 10.

Contact sections 104 of ground bus members 102 are seen exposed in large cavity 36 along mating face 32 of connector 10, centered between the rows of passageways 48 containing the inner tines (FIG. 10) of signal contacts 40. A pair of low-height alignment posts 50 are positioned at respective ends of large cavity 36 cooperable with complementary apertures of the mating connector to facilitate alignment of the connectors during mating, and which optionally can be made asymmetric to provide polarization of the mating interface.

In accordance with the present invention, ground bus members 102 are integrally molded as part of ground bus inserts 100 secured within housing 20, seen in greater particularity in FIGS. 2 to 7. In FIGS. 2 to 5, a pair of ground bus members 102 are seen stamped as blanks from sheet metal and remain joined to a carrier strip 106. Planar body section 108 of each member extends between side edges 110,112 and between a matable contact section 114 along one longitudinal edge and a board-mount section 116 along the opposed longitudinal edge, having post sections 118 initially joining the bus member to carrier strip 106. Also seen is a lance 120 formed proximate matable contact section 114 angled to extend toward board-mount section 116, and an array of perforations 122 through planar body section 108. One or more barbs 124 are provided along side edges 110,112 extending toward board-mount section 116.

Figure 7:
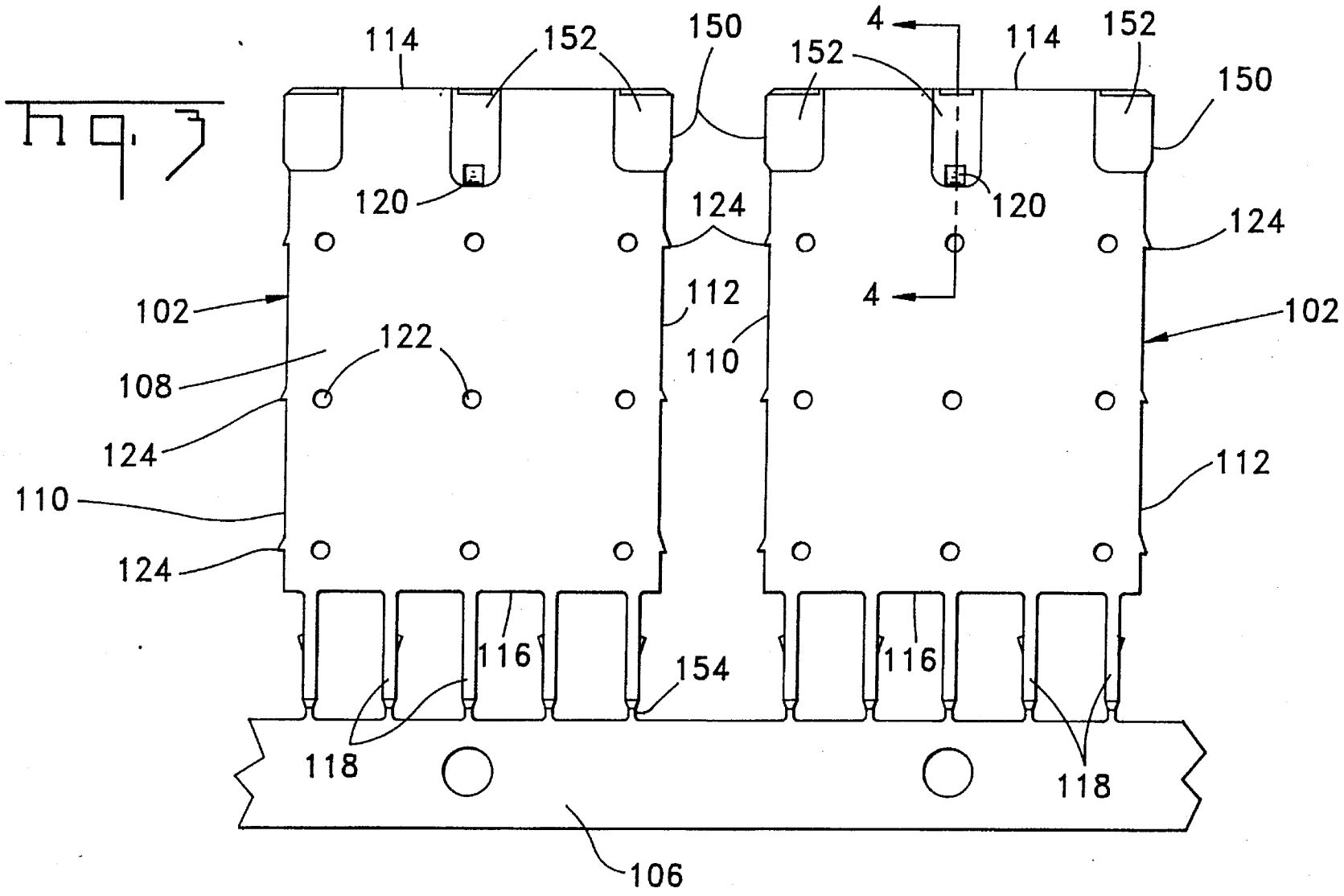
Figure 5:
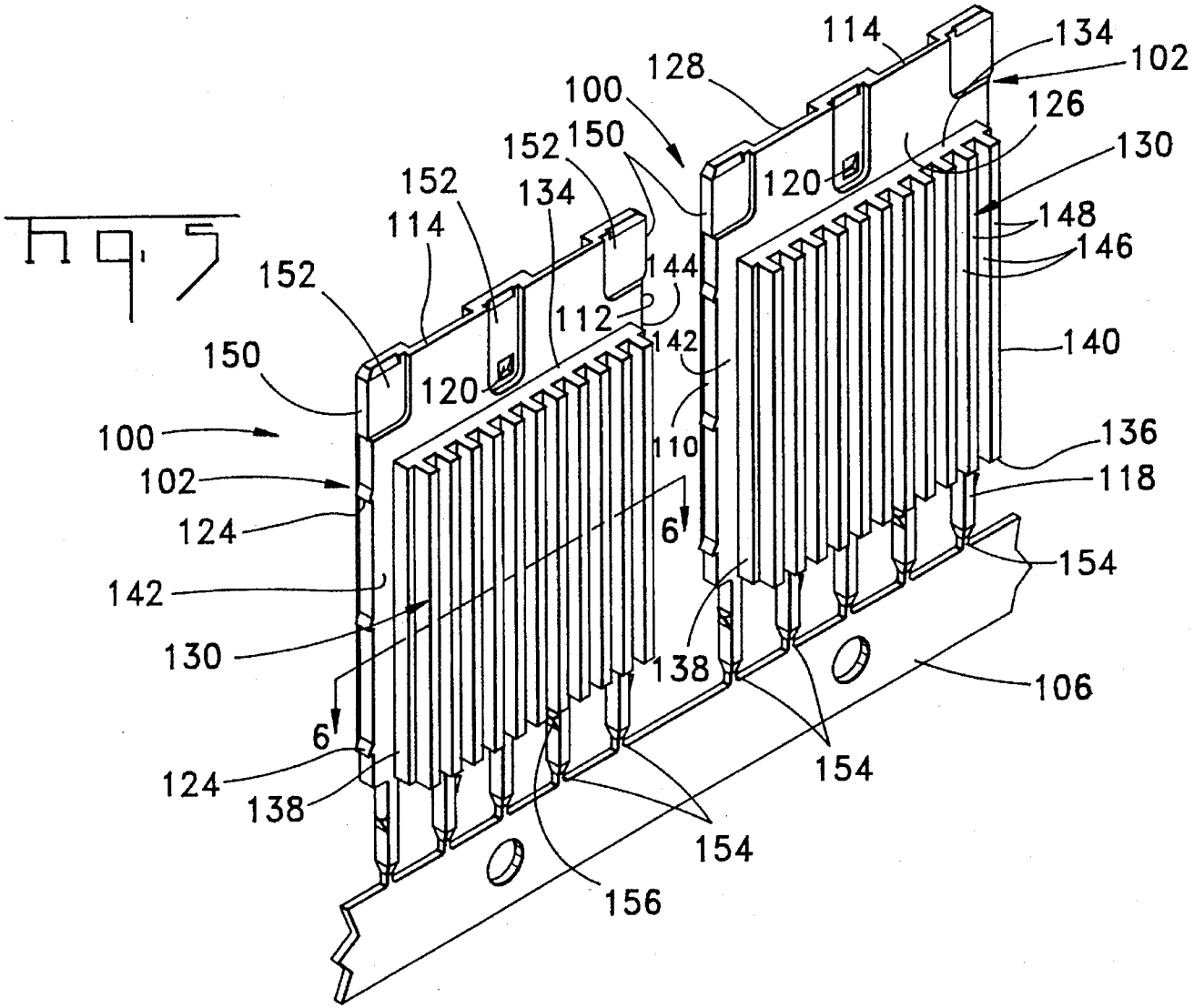

Insulative material is then molded to both major surfaces 126,128 of planar body section 108, as seen in FIGS. 5 to 7, to define covers 130, preferably while ground bus members 102 are still joined to carrier strip 106. Preferably perforations or holes 122 through planar body section 108 permit formation of column joints 132 firmly and integrally joining together the insulative material of covers 130 on both major surfaces 126,128 of the planar body section. Covers 130 extend from a coplanar edge 134 proximate mating contact section 114 of a respective bus member 102 and spaced from the free end of lance 120 a selected distance, to a coplanar edge 136 proximate board-mount section 116. Covers 130 also extend to coplanar side edges 138,140 recessed from side edges 110,112 of planar body section 108 to expose edge portions 142,144 adjacent side edges 110,112. Vertical first grooves 146 are formed in outwardly facing surfaces of covers 130, separated by low-height first barrier walls 148 and are associated with respective ones of the signal contacts of the connector.

Figure 8:
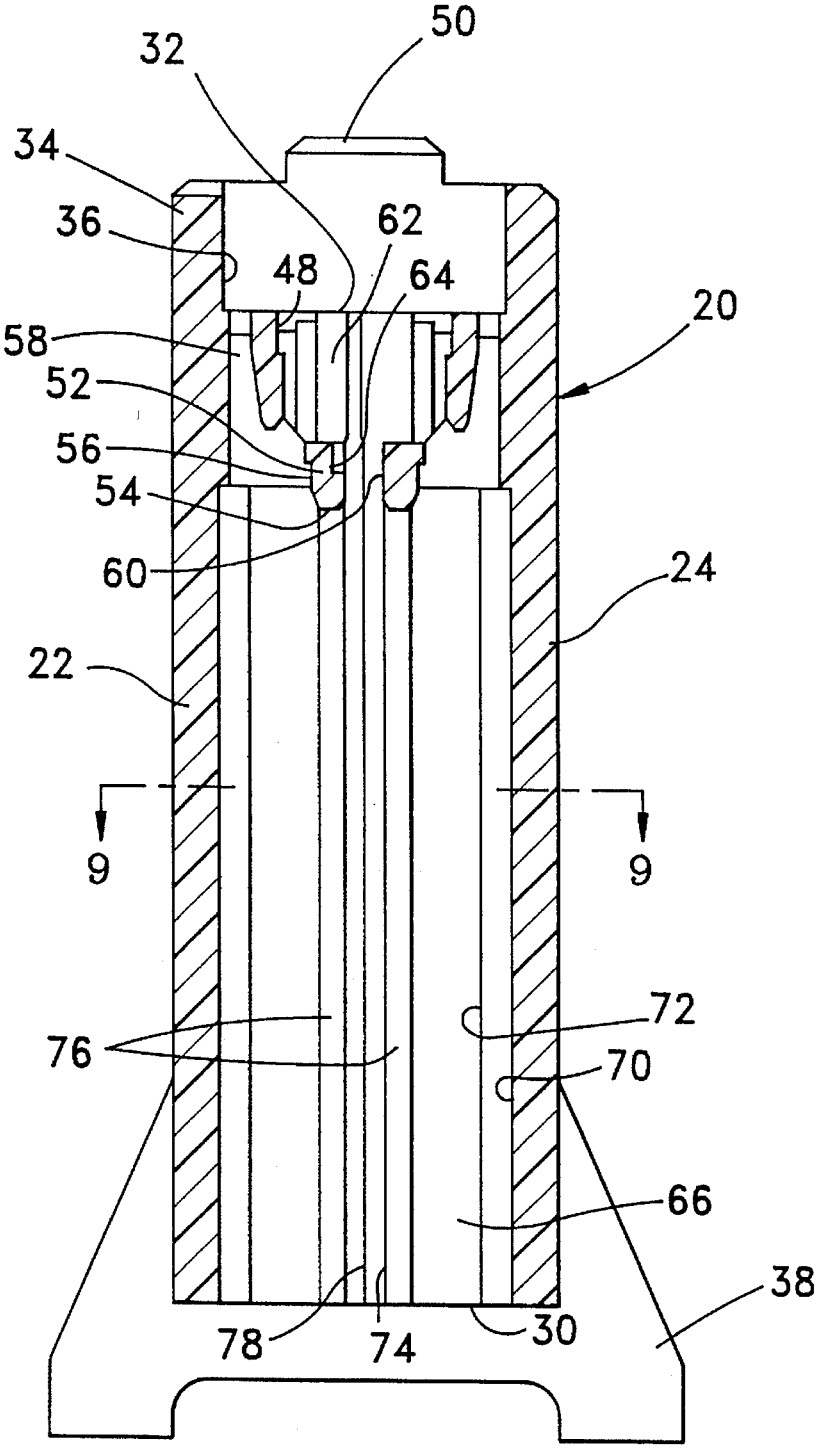
FIGS. 8 and 9 are longitudinal and transverse cross-sectional views of the molded housing member of the connector of FIG. 1, with FIG. 9 taken along lines 9—9 of FIG. 8.
Figure 9:
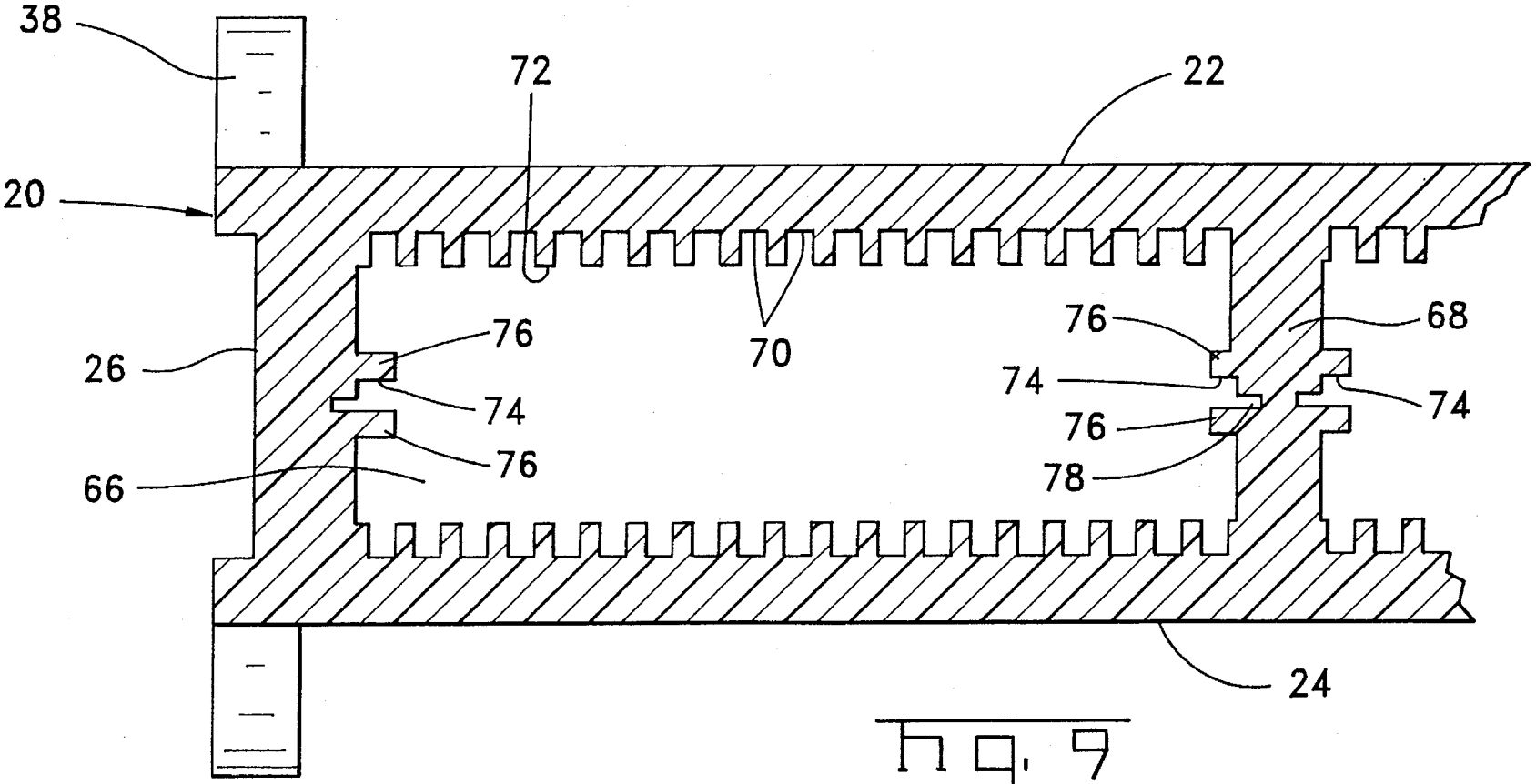
Figure 10:
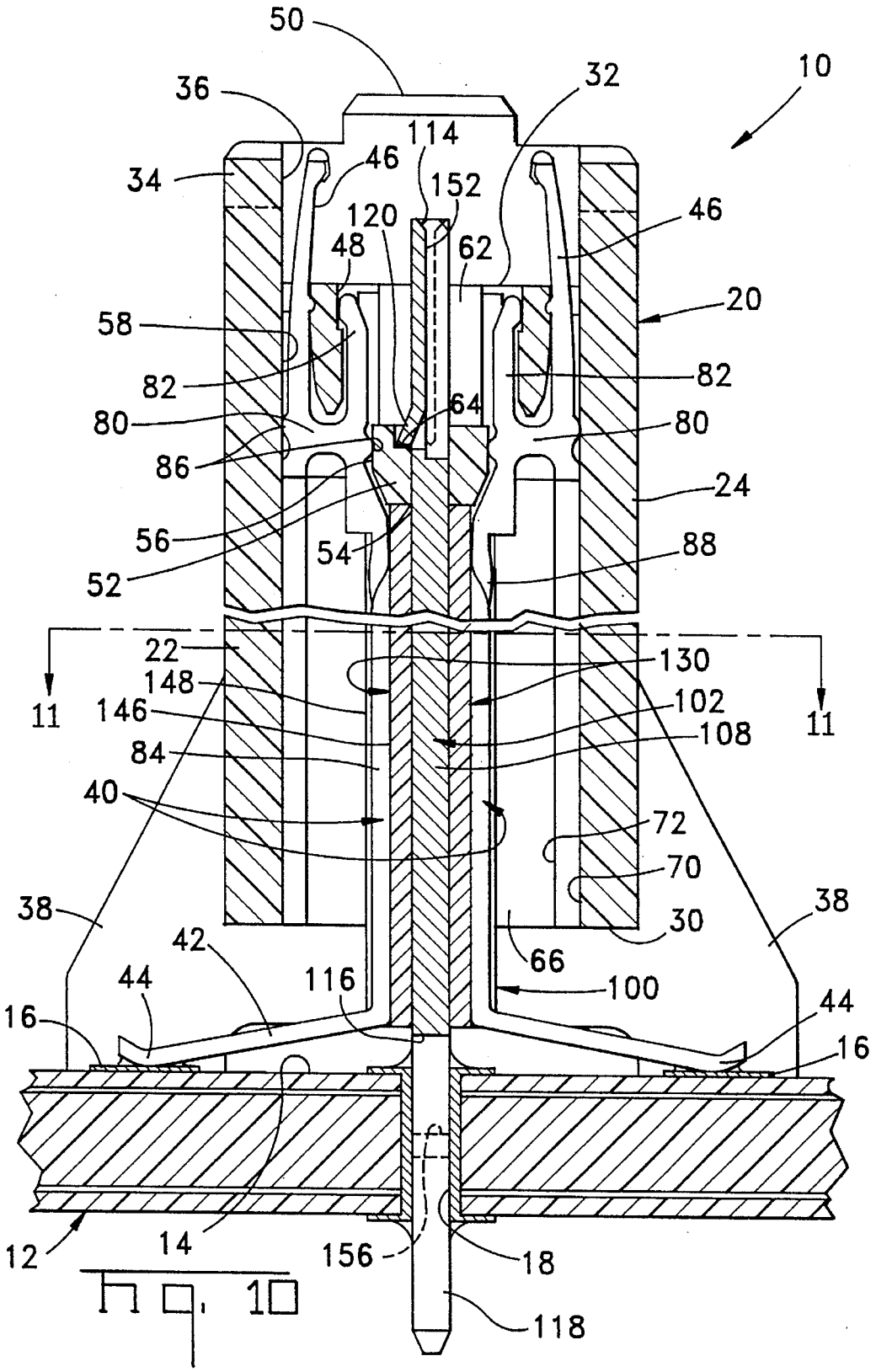
FIG. 10 is longitudinal cross-section view of the assembled connector of FIGS. 1 to 9, mounted on a circuit board and illustrating the ground bus insert and signal contacts disposed in the housing.

Referring now to FIGS. 8 and 9, housing member 20 is molded to provide a transverse body section 52 defining mating face 32 and a surface 54 facing toward the board-mounting face 30 of the connector. Extending into surface 54 are passageways 56 associated with the body sections of the signal contacts 40 (FIGS. 1 and 10). Passageways 48 are associated with inner tines communicate with passageways 56, and passageways 58 also extend from passageways 56 to mating face 32 and are associated with the outer tines of signal contacts 40. A bus-receiving slot 60 extends through transverse body section 52 from surface 54 to a central recess 62 inwardly from mating face 32, and a pocket 64 is provided to enable latching by lance 120 when ground bus insert 100 is fully inserted. An elongate large cavity 66 extends from transverse body section 52 to board-mounting face 30, bounded by side walls 22,24 and one of end walls 26,28 and an interior wall 68 and is associated with one of the ground bus inserts 100, while an adjacent elongate large cavity is associated with the other ground bus insert of the particular 76-position connector shown that utilizes a pair of ground bus inserts. Along the inwardly facing surfaces of side walls 22,24 are vertical second grooves 70 defined between low-height second barrier walls 72 and associated with respective signal contacts 40.

Best seen in FIG. 9, housing 20 is adapted for insertion thereinto of ground bus inserts 100, from board-mounting face 30 into respective elongate large cavities 66. Vertically along end walls 26,28 and opposite therefrom along interior wall 68 are a pair of guide channels 74 defined between low height flanges or ribs 76, with guide channels 74 each dimensioned incrementally wider than the thickness of a ground bus body section 108. Edge portions 142,144 follow guide channels 74 until mating contact section 114 enters and passes through bus-receiving slot 60 and mating edge 134 abuts surface 54 of transverse body section 52 of housing 20. Lance 120 is temporarily deflected to pass through bus-receiving slot 60 and then resiles outwardly into pocket 64 to latchingly engage against the latch surface of the pocket to assist in retaining ground bus insert 100 in the housing. Barbs 124 along side edges 110,112 bite into the bottom surfaces of guide channels 74 to resist rearward movement of the ground bus insert after full insertion into housing 20.

For economy of space it is desired to position signal contacts along the side edges of ground bus insert 100, at the four corners of the contact array. To this end, ribs 76 provide an insulative wall between such contacts and ground bus 102 at otherwise exposed side edge portions 142,144 and are dimensioned to be approximately as wide as the thickness of a cover 130 of insert 100. For optimum cross-talk prevention, mating contact section 114 of ground bus 102 extends slightly beyond side edges 110,112 at flange portions 150. Mating contact section 114 is shown to have reduced thickness sections 152 between ends thereof alternating from side to side, providing recesses cooperable with spring arm sections of a complementary ground bus contact section of the mating connector (not shown) in a low profile mated bus arrangement; flange portions 150 occur at respective reduced thickness sections 152 at the ends of mating contact section 114. To permit passage of reduced-thickness flange portions 150 during ground bus insert insertion, a deep groove portion 78 is molded into guide channels 74.

As shown in FIG. 8, chamfers are provided at bus-receiving slot 60 along surface 54 to facilitate receipt thereinto of mating contact section 114 of ground bus 102. Also seen in FIG. 8 are tapered surfaces defining widened entrances to passageways 48 along mating face 32 for facilitating receipt thereinto of leading ends of elongate inner tines of contact members of the mating connector (not shown) during mating. Preferably ledges are defined along inner walls of passageways 56 for controlling the depth of insertion of body sections of the signal contacts 40 during connector assembly.

Figure 11:
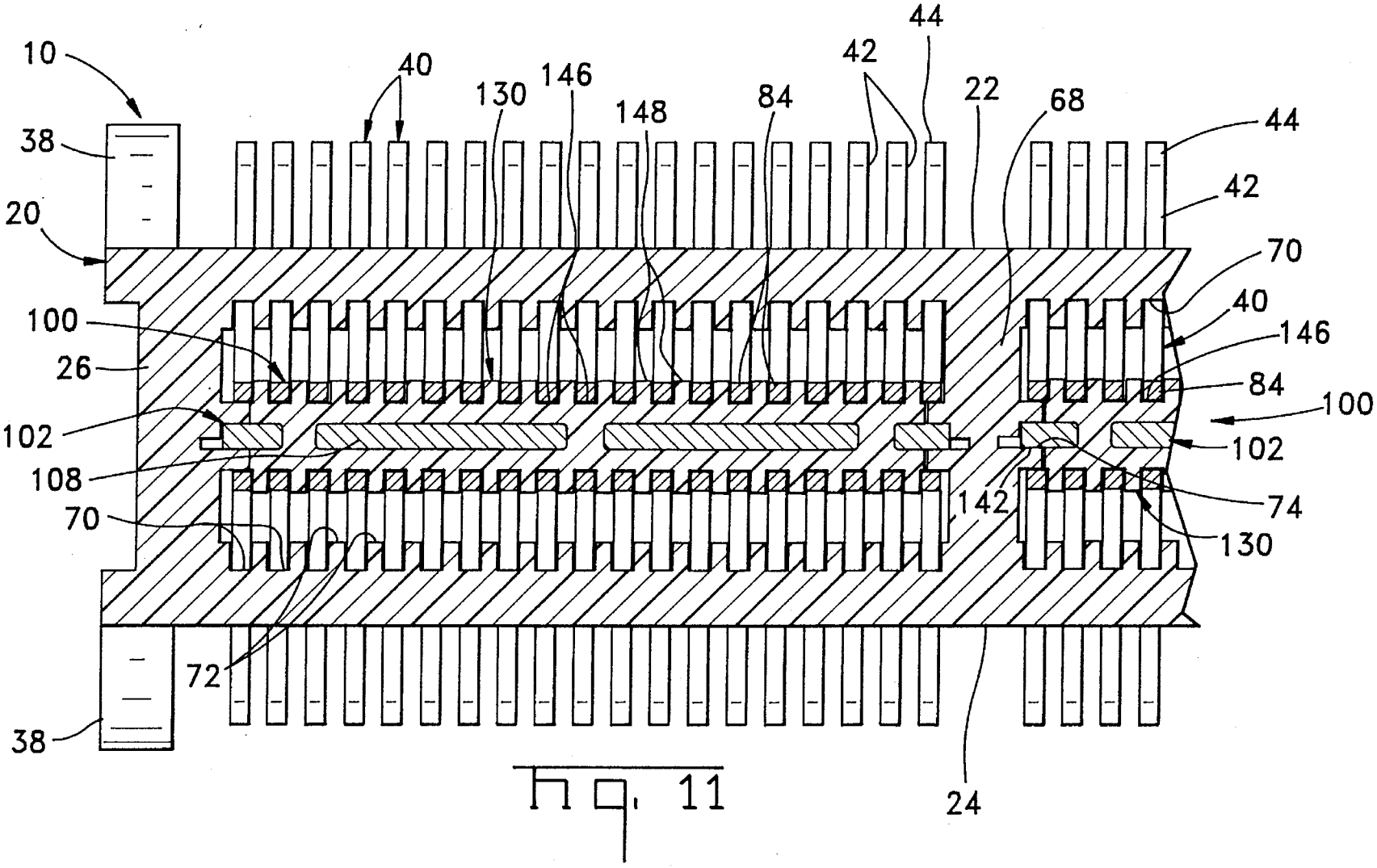
FIG. 11 is a transverse cross-sectional view of the connector of FIGS. 1 to 10 taken along lines 11—11 of FIG. 10.

FIG. 10 illustrates a fully assembled connector 10 as mounted to a circuit board 12. FIG. 11 illustrates the assembled connector facing the board-mounting face. A ground bus insert 100 is positioned within housing 20, with vertical first grooves 146 aligned with vertical second grooves 70 of housing walls 22,24, and signal contacts 40 have been inserted fully into position in the connector. Each signal contact 40 includes a body section 80, inner tine 82 associated with elongate outer tine 46 both extending forwardly from body section 80 and defining the contact's second contact section, and elongate intermediate section 84 extending from body section 80 to first contact section 42. For contact retention, several embossments 86 are defined along edges of the body section of the contact to provide an interference fit with inner and outer walls of passageway 56.

Signal contacts 40 are insertable from board-mounting face 30 into housing 20 with body sections 80 thereof located in opposing grooves 70,146 aligned with passageways 56. Tapered and chamfered entrances to passageway 56 and to passageways 58,48 facilitate deflection of leading ends of inner and outer tines 82,46 thereinto upon initial entry during assembly. Elongate intermediate contact sections 84 reside within grooves 146 in covers 130 of ground bus insert 100 upon full insertion into connector 10. Signal contacts 40 are shown twisted 90° at 88 of intermediate sections 84 such that first contact sections 42 may be formed by bending about an axis parallel to the plane of the strip and to the grain of the metal's crystalline microstructure, to extend along surface 14 of circuit board 12. This is preferred in such miniature contact members rather than for the contact section to be stamped in that shape from metal strip or bent perpendicular to the grain, in order to provide more resilient spring members facilitating the desirable deflection upwardly after engagement with conductive pads 16 under compression, upon mounting of connector 10 onto circuit board 12 prior to soldering.

Figure 12:
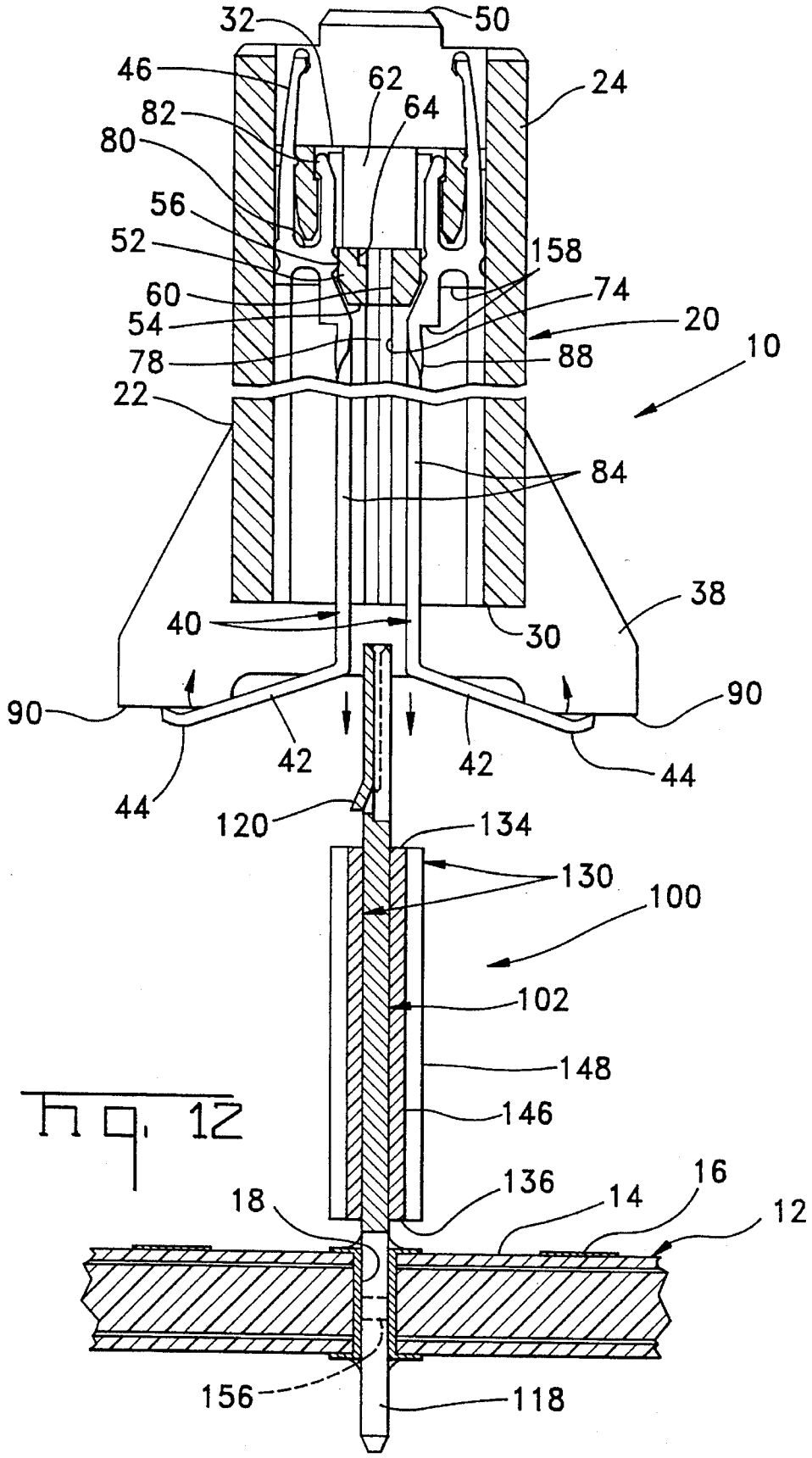
FIG. 12 is a longitudinal cross-sectional view of the connector housing of FIGS. 8 and 9 having signal contacts secured therein, with the ground bus insert secured to the circuit board, illustrating an alternate assembly technique.

Connector 10 may be assembled by, first, inserting ground bus inserts 100 into housing 20 and subsequently inserting signal contacts 40 thereinto, thus defining a complete assembly prior to mounting onto circuit board 12. Alternatively as illustrated in FIG. 12, ground bus inserts 100 may be first mounted in position onto circuit board 12 with post sections 118 force fit into plated through-holes 18 of the circuit board, after which housing 20 containing signal contacts 40 secured therein by force fit into passageways 56 is carefully placed over ground bus inserts 100 until abutment of surface 54 of housing 20 and edges 134 of covers 130 and latching of lance 120 in pocket 64. FIG. 12 also illustrates that preferably, free ends 44 of first contact sections 42 of contacts 40 extend beneath the plane defined by bottom surfaces 90 of buttresses 38, in order to engage respective conductor pads 16 of circuit board 12 prior to abutment of bottom surfaces 90 of buttresses 38 with surface 14 of circuit board 12; this assures engagement of first contact sections 42 with conductive pads 16 under modest normal force prior to soldering, and thereby assure satisfactory solder joints. Push surfaces 158 are seen facing opposed to the direction of contact insertion, to be engaged by insertion tooling (not shown) preventing damage to the contact members.

Ground bus inserts 100 may be fabricated by forming ground bus members 102 from brass, for example, and conventional plating if desired, and subsequently molding thereto covers 130 from dielectric plastic material such as liquid crystal polymer resin optionally with use of bonding agent. During molding, ground bus member 100 is preferably firmly gripped continuously about edge portions 142, 144 and portions of planar body section 108 adjacent matable contact section 114 and board mount edge 116, by cavity walls of the mold apparatus (not shown) to assure close-off to retain the resin in the mold cavity. After molding of covers 130, the ground bus inserts may be removed from carrier strip 106 such as at frangible sections 154 defined at ends of post sections 118.

Housing 20 may be molded for example from thermoplastic resin such as liquid crystal polymer. Signal contacts may be stamped from 0.008 inches thick stock of beryllium copper alloy. If desired, post sections 118 of ground bus members may be provided with barbs 156 to enhance retention to circuit board 12 prior to soldering, in that in a force fit relationship of post sections 118 in the plated through-holes the barbs will resist inadvertent withdrawal from through-holes 18 of the circuit board prior to soldering. Such resistance to withdrawal is desirable to overcome the collective forces resulting from deflection of free ends 44 of first contact sections 42 of signal contacts 40 upon full mounting to the circuit board prior to soldering; it is also useful if ground bus inserts 100 are first mounted to the circuit board as in FIG. 12.

It is seen that with the present invention, the deliberately increased height of the connector does not complicate the fabrication of the housing nor complicate the assembly of contact members and ground bus into the housing. The present invention can also be utilized in miniature connectors not requiring a ground bus but yet having elongate contacts disposed in two rows, by recessing the upper and lower edges of a metal plate member within the insulative covering while exposing the side edge portions to facilitate insertion and retention within the housing, thus retaining precision of thin wall dimensions and the integrity of the housing and contact members during and after assembly.

Variations and modifications may be made to the specific embodiment disclosed herein, that are within the spirit of the invention and the scope of the claims.

We claim:

1. A miniature electrical connector of the type having a plurality of contact members with elongate body sections between contact sections at opposed ends thereof, that are disposed closely spaced in two closely spaced rows within a housing, comprising:

a housing providing opposed side walls and opposed end walls and extending between a mating face and an insertion face opposed therefrom;

a plurality of contact members each having an elongate body section extending from a first contact section to a second contact section; and an insert securable to and within said housing to be disposed between said two rows of contact members from a first end associated with said insertion face of said housing to a second end associated with said mating face thereof, said insert providing dielectric material at least along surfaces facing outwardly toward said side walls of said housing, and said insert further including retention sections along opposed end edges thereof facing said end walls of said housing, outwardly facing surfaces of said dielectric material including an array of first vertical low height barrier walls defining an array of first grooves also associated with respective ones of said contact members and extending from said first end adjacent said insertion face of said housing to at least proximate said second end adjacent said mating face, and inwardly facing surfaces of said side walls including an array of second vertical low height barrier walls defining an array of second grooves associated with respective ones of said contact members and extending from said insertion face to at least proximate said mating face, whereby each said contact member is disposed between said inwardly facing surface of said housing and a said outwardly facing surface of said insert and with said first contact section exposed along said insertion face and said second contact section exposed along said mating face, and with inner and outer edges thereof passing along and within opposed first and second grooves during insertion and elongate intermediate sections thereof are disposed within a respective one of said first and second grooves after full insertion, said first and second grooves facilitating insertion of said contact members into said housing while enabling thin dimensioning of wall structures sufficiently engageable with said contact members at inner and outer edges thereof for precisely positioning them closely together.

2. The connector as set forth in claim 1 wherein said insert includes a planar metal member centrally therein and having said dielectric material thereof disposed along both major side surfaces thereof, with edge portions at each end exposed for being positioned within vertical guide channels defined along inwardly facing surfaces of said end walls of said housing.

3. The connector as set forth in claim 2 wherein said planar metal member includes said retention sections along edges of said exposed edge portions.

4. The connector as set forth in claim 3 wherein said retention sections are barbs penetrating into surfaces of said housing end walls in said guide channels when said insert is dimensioned to fit tightly in said housing upon full insertion thereinto, to assuredly hold said insert therein.

5. The connector as set forth in claim 2 wherein said planar metal member includes a plurality of holes therethrough enabling dielectric material along both said major side surfaces of said planar metal member to form joints through said holes, facilitating securing of said dielectric material to said planar metal member.

6. The connector as set forth in claim 2 wherein at least one post portion extends beyond said first end of said insert for insertion into a hole of a circuit board when the connector is mounted thereto.

7. The connector as set forth in claim 6 wherein said planar metal member includes a portion extending beyond said second end of said insert to define a contact section, and when said at least one portion is connected to a ground circuit of said circuit board, said planar metal member defines a ground bus preventing crosstalk between said contact members when electronic signals are transmitted therethrough.

8. The connector as set forth in claim 7 wherein said contact section of said planar metal member includes at least contact end portions extending slightly beyond said end edges of said planar metal member, said contact end portions having a reduced thickness, and said guide channels of said housing end walls include deepened portions into bottom surfaces thereof permitting passage therealong of said contact end portions during insertion of said insert into said housing.

9. The connector as set forth in claim 7 wherein said guide channels in said housing end walls each are defined between a pair of flanges extending inwardly from a respective said housing end wall, with each said flange having a width approximately equal to the thickness of said dielectric material along each said major surface of said planar metal member of said insert, thereby insulating said exposed end portions of said planar metal member permitting location of a respective said contact member along said end wall of said housing, maximizing the number of said contact members contained within said housing.

10. A miniature electrical connector of the type having a plurality of contact members with body sections between first contact sections for connection to circuits of a circuit board upon mounting of the connector thereto and second contact sections for mating with contacts of a mating connector, that are disposed closely spaced in two closely spaced rows within a housing having side walls and end walls extending between a mating face and a board-mounting face, and including a ground bus centrally positioned between said two rows of contact members and having a contact section exposed at said mating face and a plurality of posts extending from said board-mounting face, with the housing providing a thin layer of insulative material between a body section of the ground bus and the contact members, the improvement comprising:

said housing molded to provide a large central cavity from said board-mounting face to a housing body section of limited dimension adjacent said mating face, with said housing body section providing openings permitting said second contact sections of said contact members to be inserted therethrough during connector assembly to be exposed along said mating face for mating engagement with complementary contact sections of contact members of a mating connector, and said housing body section further including a slot permitting insertion therethrough of said ground bus contact section during connector assembly to be exposed for mating with a ground bus of the mating connector; and an insert securable to and within said large cavity of said housing adjacent said housing body section to be disposed between said two rows of contact members from a first end associated with said board-mounting face of said housing to a second end associated with said mating face thereof, said insert including said ground bus and providing dielectric material along major surfaces of said body section thereof facing outwardly toward said side walls of said housing, and said insert further including retention sections along opposed side edges thereof facing said end walls of said housing.

11. The connector as set forth in claim 10 wherein:

outwardly facing surfaces of said dielectric material including an array of first vertical low height barrier walls defining an array of first grooves also associated with respective ones of said contact members and extending from said first end adjacent said board-mounting face of said housing to at least proximate said second end adjacent said mating face, inwardly facing surfaces of said side walls including an array of second vertical low height barrier walls defining an array of second grooves associated with respective ones of said contact members and extending from said board-mounting face to at least proximate said mating face, whereby each said contact member is disposed between said inwardly facing surface of said housing and a said outwardly facing surface of said insert, and with inner and outer edges thereof within opposed first and second grooves, said first and second grooves facilitating insertion of said contact members into said housing while enabling thin dimensioning of wall structures sufficiently engageable with said contact members at inner and outer edges thereof for precisely positioning them closely together.

12. The connector as set forth in claim 10 wherein said ground bus is a planar metal member centrally disposed in said insert and having said dielectric material thereof disposed along both major side surfaces of said ground bus body section, with edge portions at each end exposed for being positioned within vertical guide channels defined along inwardly facing surfaces of said end walls of said housing.

13. The connector as set forth in claim 12 wherein said planar metal member includes said retention sections along edges of said exposed edge portions.

14. The connector as set forth in claim 13 wherein said retention sections are barbs penetrating into surfaces of said housing end walls in said guide channels when said insert is dimensioned to fit tightly in said housing upon full insertion thereinto, to assuredly hold said insert therein.

15. The connector as set forth in claim 12 wherein said planar metal member includes a plurality of holes therethrough enabling dielectric material along both said major side surfaces of said planar metal member to form joints through said holes, facilitating securing of said dielectric material to said planar metal member.

16. The connector as set forth in claim 12 wherein said contact section of said planar metal member includes at least contact end portions extending slightly beyond said end edges of said planar metal member, said contact end portions having a reduced thickness, and said guide channels of said housing end walls include deepened portions into bottom surfaces thereof permitting passage therealong of said contact end portions during insertion of said insert into said housing.

17. The connector as set forth in claim 12 wherein said guide channels in said housing end walls each are defined between a pair of flanges extending inwardly from a respective said housing end wall, with each said flange having a width approximately equal to the thickness of said dielectric material along each said major surface of said planar metal member of said insert, thereby insulating said exposed end portions of said planar metal member permitting location of a respective said contact member along said end wall of said housing, maximizing the number of said contact members contained within said housing.

* * * * *